US007731600B1

(12) United States Patent
Diesterheft

(10) Patent No.: US 7,731,600 B1
(45) Date of Patent: Jun. 8, 2010

(54) TRUE ALIGNMENT PUTTER SYSTEM

(76) Inventor: Richard W. Diesterheft, 6425 Shoreline Dr., #10105, St. Petersburg, FL (US) 33708

( * ) Notice: Subject to any disclaimer, the term of this patent is extended or adjusted under 35 U.S.C. 154(b) by 0 days.

(21) Appl. No.: 12/462,510

(22) Filed: Aug. 5, 2009

(51) Int. Cl.
*A63B 69/36* (2006.01)
*A63B 53/04* (2006.01)
*A63B 53/06* (2006.01)

(52) U.S. Cl. ..... 473/254; 473/336; 473/340; 473/341

(58) Field of Classification Search ..... 473/242–255, 473/340, 341, 334–339; D21/736–746
See application file for complete search history.

(56) References Cited

U.S. PATENT DOCUMENTS

D228,563 S * 10/1973 Brower ..... D21/744
3,880,430 A * 4/1975 McCabe ..... 473/253
4,043,562 A * 8/1977 Shillington ..... 473/254
4,136,877 A * 1/1979 Antonious ..... 473/254
D256,262 S * 8/1980 Benson ..... D21/745
4,995,612 A * 2/1991 Finney ..... 473/341
5,060,950 A * 10/1991 Finney ..... 473/341
5,211,401 A * 5/1993 Hainey ..... 473/340
5,248,145 A * 9/1993 Brown ..... 473/254
5,344,149 A * 9/1994 Miller ..... 473/341
6,062,986 A * 5/2000 Kaise ..... 473/242
6,379,259 B1 * 4/2002 Opie ..... 473/251
6,450,894 B1 * 9/2002 Sun et al. ..... 473/252
6,663,505 B1 * 12/2003 Solari ..... 473/334
7,101,288 B2 * 9/2006 Thomas ..... 473/242
2003/0228926 A1 * 12/2003 Wang ..... 473/252

* cited by examiner

*Primary Examiner*—Sebastiano Passaniti

(57) ABSTRACT

A generally cylindrical shaft has upper and lower ends and a handle at the upper end. A putter head has a forward face plate and a rear, a sole plate below and a weight plate above, a toe and a heel. The weight plate and the sole plate each have an upper and lower surface. The lower end of the shaft is coupled to the upper surface of the weight plate adjacent to the heel. An alignment assembly includes an upper line on the upper surface of the weight plate and a lower line on the upper surface of the sole plate parallel with and spaced from the toe and the heel. The upper line is located above and parallel with the lower line. The lower line extends rearwardly a greater distance than the upper line.

3 Claims, 2 Drawing Sheets

FIG 3
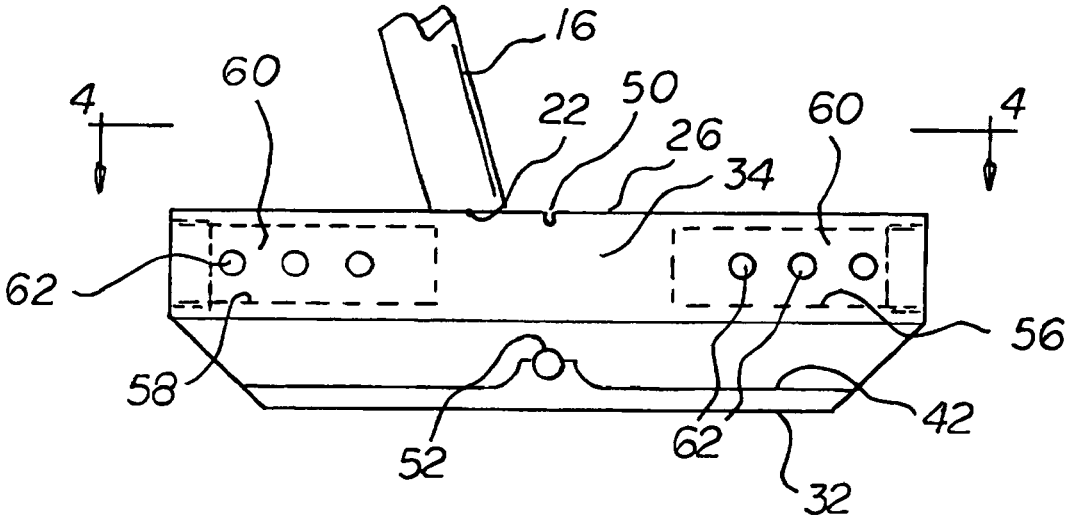
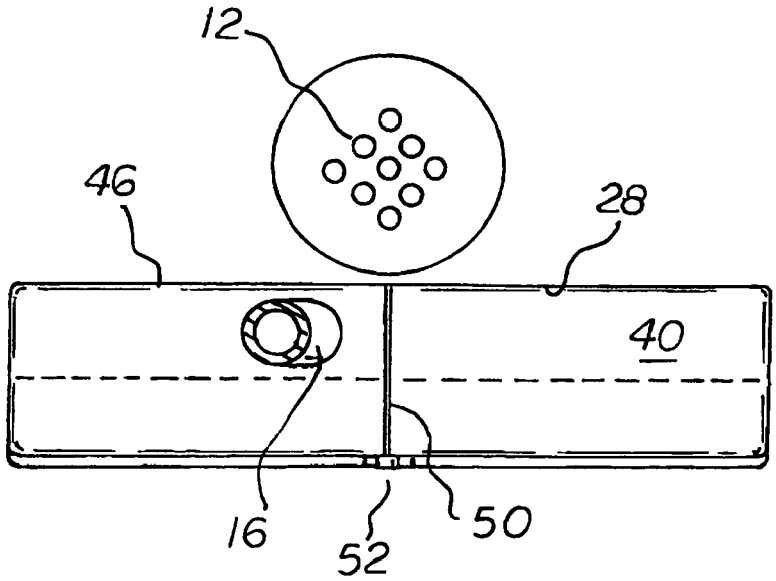
FIG 4

TRUE ALIGNMENT PUTTER SYSTEM

BACKGROUND OF THE INVENTION

1. Field of the Invention

The present invention relates to a true putter alignment system and more particularly pertains to ensuring the correct alignment of a golf ball with respect to a hole, the alignment being cone in a reliable, repeatable and economical manner.

2. Description of the Prior Art

The use of alignment putter systems of known designs and configurations is known in the prior art. More specifically, alignment putter systems of known designs and configurations previously devised and utilized for the purpose of aligning a golf ball with respect to a hole are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,995,612 issued Feb. 26, 1991 to Finney discloses a Golf Clubhead in a Corner-Back Configuration. U.S. Pat. No. 5,060,950 issued Oct. 29, 1991 to Finney discloses a Corner-Back Clubhead. Lastly, U.S. Pat. No. 6,379,259 issued Apr. 30, 2002 to Opie discloses a Golf Putter.

While these devices fulfill their respective, particular objectives and requirements, the aforementioned patents do not describe true putter alignment system that allows ensuring the correct alignment of a golf ball with respect to a hole, the alignment being cone in a reliable, repeatable and economical manner.

In this respect, the true putter alignment system according to the present invention substantially departs from the conventional concepts and designs of the prior art, and in doing so provides an apparatus primarily developed for the purpose of ensuring the correct alignment of a golf ball with respect to a hole, the alignment being cone in a reliable, repeatable and economical manner.

Therefore, it can be appreciated that there exists a continuing need for a new and improved true putter alignment system which can be used for ensuring the correct alignment of a golf ball with respect to a hole, the alignment being cone in a reliable, repeatable and economical manner. In this regard, the present invention substantially fulfills this need.

SUMMARY OF THE INVENTION

In view of the foregoing disadvantages inherent in the known types of alignment putter systems of known designs and configurations now present in the prior art, the present invention provides an improved true putter alignment system. As such, the general purpose of the present invention, which will be described subsequently in greater detail, is to provide a new and improved true putter alignment system and method which has all the advantages of the prior art and none of the disadvantages.

To attain this, the present invention essentially comprises a shaft in a generally cylindrical configuration having an upper end and a lower end. A handle is provided at the upper end for being gripped by a player.

Next provided is a head of a putter. The head of the putter has a face plate forwardly and a rear separated by a depth. The head has a sole plate below of a first thickness and a first length. The head has a weight plate above of a second thickness and a second length. The head of the putter has a toe outwardly and a heel inwardly. The weight plate has an upper surface and the sole plate has an upper surface. The lower end of the shaft is coupled to the upper surface of the weight plate adjacent to the heel. The first thickness is between 4 and 6 times greater than the second thickness. A space between the sole plate and the weight plate is of a height between 2 and 4 times greater than the first thickness of the sole plate. The first length of the sole plate is between 70 percent and 90 percent of the second length of the weight plate. The sole plate has a horizontal lower surface for proper positioning on a putting surface. The face plate has a vertical front surface for striking of a ball.

Next provided is an alignment assembly. The alignment assembly includes an upper line on the upper surface of the weight plate parallel with and equally spaced from the toe and the heel. A lower line on the upper surface of the sole plate is parallel with and equally spaced from the toe and the heel. The upper line is located above and parallel with the lower line. The lower line extends rearwardly a greater distance than the upper line whereby the player standing over the head of the putter may align the upper and lower lines with respect to the ball and the hole.

Lastly, a weighting assembly is provided. The weighting assembly includes a cylindrical toe recess formed in the toe of the weight plate and a cylindrical heel recess formed in the heel of the weight plate. The weighting assembly also includes cylinders removably positioned in the toe recess and the heel recess for proper weighting for the player. Threaded set screws in the weight plate between the rear of the weight plate and the recesses couple the cylinders in the recesses.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is, therefore, an object of the present invention to provide a new and improved true putter alignment system which has all of the advantages of the prior art alignment putter systems of known designs and configurations and none of the disadvantages.

It is another object of the present invention to provide a new and improved true putter alignment system which may be easily and efficiently manufactured and marketed.

It is further object of the present invention to provide a new and improved true putter alignment system which is of durable and reliable constructions.

An even further object of the present invention is to provide a new and improved true putter alignment system which is susceptible of a low cost of manufacture with regard to both materials and labor, and which accordingly is then susceptible of low prices of sale to the consuming public, thereby making such true putter alignment system economically available to the buying public.

Even still another object of the present invention is to provide a true putter alignment system for ensuring the correct alignment of a golf ball with respect to a hole, the alignment being cone in a reliable, repeatable and economical manner.

Lastly, it is an object of the present invention to provide a new and improved true alignment putter system having a generally cylindrical shaft has upper and lower ends and a handle at the upper end. A putter head has a forward face plate and a rear, a sole plate below and a weight plate above, a toe and a heel. The weight plate and the sole plate each have an upper and lower surface. The lower end of the shaft is coupled to the upper surface of the weight plate adjacent to the heel. An alignment assembly includes an upper line on the upper surface of the weight plate and a lower line on the upper surface of the sole plate parallel with and spaced from the toe and the heel. The upper line is located above and parallel with the lower line. The lower line extends rearwardly a greater distance than the upper line.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a rear elevational view taken along line 3-3 of FIG. 2.

FIG. 4 is a cross sectional view taken along line 4-4 of FIG. 3.

The same reference numerals refer to the same parts throughout the various Figures.

DESCRIPTION OF THE PREFERRED EMBODIMENT

Figure 1:
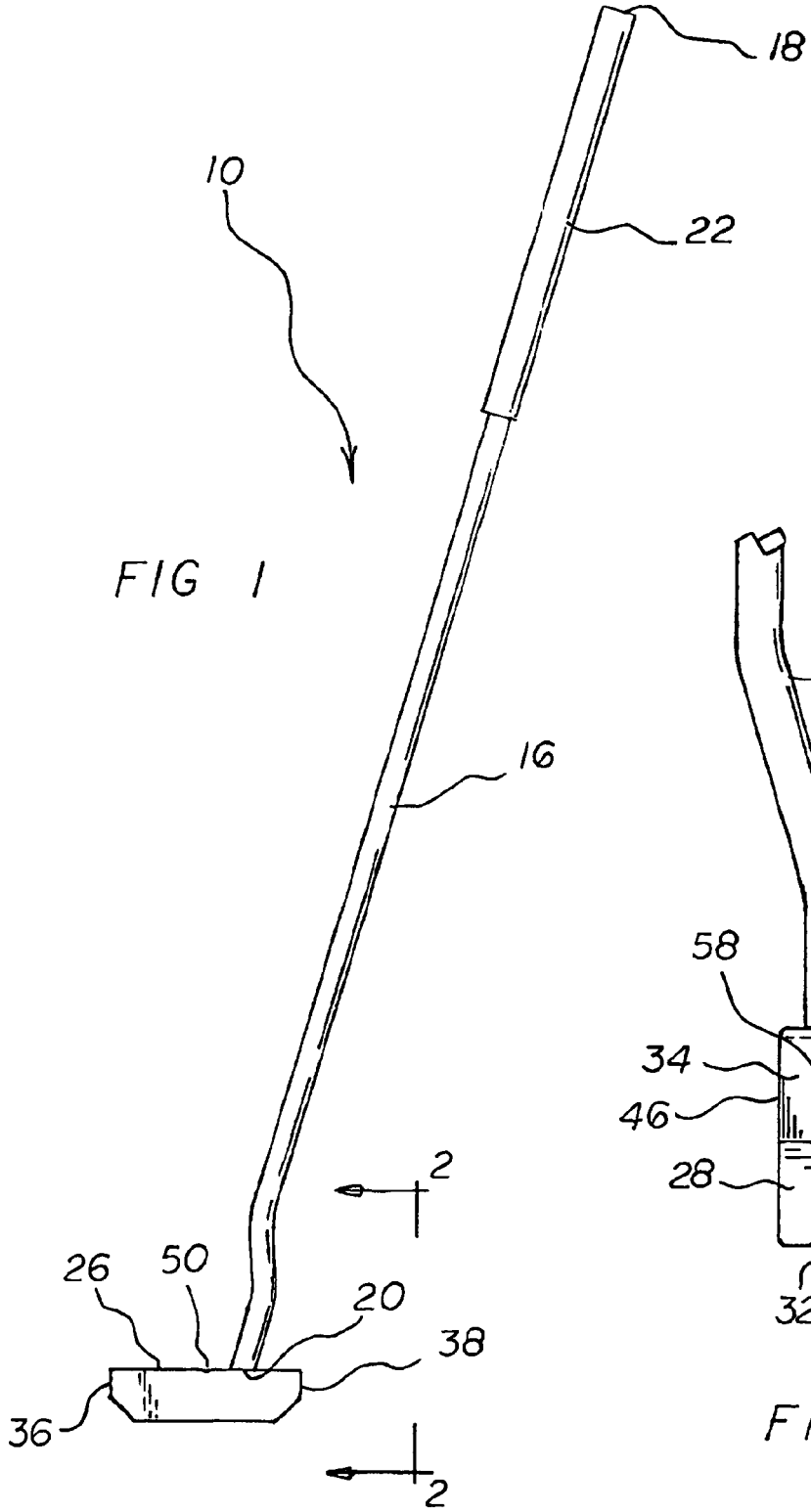
FIG. 1 is a front elevational view of a true alignment putter system constructed in accordance with the principles of the present invention.
Figure 2:
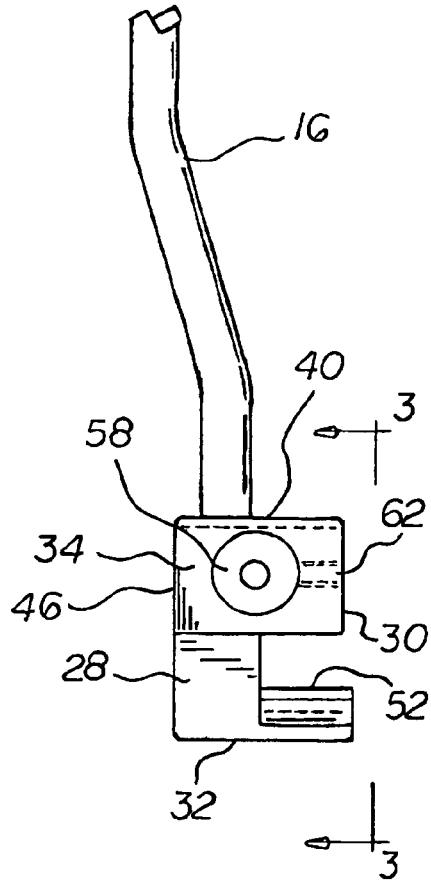
FIG. 2 is a side elevational view of the lower portion of the system taken along line 2-2 of FIG. 1.

With reference now to the drawings, and in particular to FIG. 1 thereof, the preferred embodiment of the new and improved true putter alignment system embodying the principles and concepts of the present invention and generally designated by the reference numeral 10 will be described.

The present invention, the true putter alignment system 10 is comprised of a plurality of components. Such components in their broadest context include a shaft, a head, and an alignment assembly. Such components are individually configured and correlated with respect to each other so as to attain the desired objective.

The true alignment putter system 10 is for ensuring the correct alignment of a golf ball 12 with respect to a hole. The alignment is accomplished in a reliable, repeatable and economical manner. First provided is a shaft 16 in a generally cylindrical configuration having an upper end 18 and a lower end 20. A handle 22 is provided at the upper end for being gripped by a player.

Next provided is a head 26 of a putter. The head of the putter has a face plate 28 forwardly and a rear 30 separated by a depth. The head has a sole plate 32 below of a first thickness and a first length. The head has a weight plate 34 above of a second thickness and a second length. The head of the putter has a toe 36 outwardly and a heel 38 inwardly. The weight plate has an upper surface 40 and the sole plate has an upper surface 42. The lower end of the shaft is coupled to the upper surface of the weight plate adjacent to the heel. The first thickness is between 4 and 6 times greater than the second thickness. A space between the sole plate and the weight plate is of a height between 2 and 4 times greater than the first thickness of the sole plate. The first length of the sole plate is between 70 percent and 90 percent of the second length of the weight plate. The sole plate has a horizontal lower surface 44 for proper positioning on a putting surface. The face plate has a vertical front surface 46 for striking of a ball.

Next provided is an alignment assembly. The alignment assembly includes an upper line 50 on the upper surface of the weight plate parallel with and equally spaced from the toe and the heel. A lower line 52 on the upper surface of the sole plate is parallel with and equally spaced from the toe and the heel. The upper line is located above and parallel with the lower line. The lower line extends rearwardly a greater distance than the upper line whereby the player standing over the head of the putter may align the upper and lower lines with respect to the ball and the hole.

Lastly, a weighting assembly is provided. The weighting assembly includes a cylindrical toe recess 56 formed in the toe of the weight plate and a cylindrical heel recess 58 formed in the heel of the weight plate. The weighting assembly also includes cylinders 60 removably positioned in the toe recess and the heel recess for proper weighting for the player. Threaded set screws 62 in the weight plate between the rear of the weight plate and the recesses couple the cylinders in the recesses.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A true alignment putter system comprising:

a shaft in a generally cylindrical configuration having upper and lower ends and a handle at the upper end;

a head having a forward face plate and a rear, a sole plate below and a weight plate above, the weight plate being of a first thickness and the sole plate of a second thickness, the first thickness being between 4 and 6 times greater than the second thickness, the length of the sole plate being between 70 percent and 90 percent of the length of the weight plate, a toe and a heel, the weight plate and the sole plate each having an upper and lower surface, a space between the sole plate and the weight plate being of a height between 2 and 4 times greater than the thickness of the sole plate; the lower end of the shaft being coupled to the upper surface of the weight plate adjacent to the heel; and an alignment assembly including an upper line on the upper surface of the weight plate and a lower line on the upper surface of the sole plate parallel with and spaced from the toe and the heel, the upper line being located above and parallel with the lower line, the lower line extending rearwardly a greater distance than the upper line.

2. A true alignment putter system comprising:

a shaft in a generally cylindrical configuration having upper and lower ends and a handle at the upper end;

a head having a forward face plate and a rear, a sole plate below and a weight plate above, a toe and a heel, the weight plate and the sole Plate each having an upper and lower surface, the lower end of the shaft being coupled to the upper surface of the weight plate adjacent to the heel;

an alignment assembly including an upper line on the upper surface of the weight plate and a lower line on the upper surface of the sole plate parallel with and spaced from the toe and the heel, the upper line being located above and parallel with the lower line, the lower line extending rearwardly a greater distance than the upper line; and a weighting assembly including:

a cylindrical toe recess formed in the toe of the weight plate;

a cylindrical heel recess formed in the heel of the weight plate;

a first cylinder removably positioned in the toe recess and a second cylinder removably positioned in the heel recess for proper weighting for a player; and threaded set screws in the weight plate between the rear of the weight plate and the recesses for coupling the cylinders in the recesses.

3. A true alignment putter system for ensuring the correct alignment of a golf ball with respect to a hole, the alignment being in a reliable, repeatable and economical manner, the system comprising, in combination:

a shaft in a generally cylindrical configuration having an upper end and a lower end, a handle at the upper end for being gripped by a player;

a head of a putter having a face plate forwardly and a rear separated by a depth, a sole plate below of a first thickness and a first length, a weight plate above of a second thickness and a second length, a toe outwardly and a heel inwardly, the weight plate having an upper surface, the sole plate having an upper surface, the lower end of the shaft being coupled to the upper surface of the weight plate adjacent to the heel, the first thickness being between 4 and 6 times greater than the second thickness, a space between the sole plate and the weight plate being of a height between 2 and 4 times greater than the first thickness of the sole plate, the first length of the sole plate being between 70 percent and 90 percent of the second length of the weight plate, the sole plate having a horizontal lower surface for proper positioning on a putting surface, the face plate having a vertical front surface for striking of the ball;

an alignment assembly including an upper line on the upper surface of the weight plate parallel with and equally spaced from the toe and the heel, a lower line on the upper surface of the sole plate parallel with and equally spaced from the toe and the heel, the upper line being located above and parallel with the lower line, the lower line extending rearwardly a greater distance than the upper line whereby the player standing over the head of the putter may align the upper and lower lines with respect to the ball and the hole; and a weighting assembly including a cylindrical toe recess formed in the toe of the weight plate and a cylindrical heel recess formed in the heel of the weight plate, cylinders removably positioned in the toe recess and the heel recess for proper weighting for the player, threaded set screws in the weight plate between the rear of the weight plate and the recesses for coupling the cylinders in the recesses.

* * * * *